US006233999B1

(12) United States Patent
Yabutani et al.

(10) Patent No.: US 6,233,999 B1
(45) Date of Patent: May 22, 2001

(54) METHOD FOR IRONING SPLINE TEETH IN PRESSED STEPPED SHEETMETAL AND SHEETMETAL CLUTCH DRUM FORMED BY SAME

(75) Inventors: Mitsumasa Yabutani; Satoru Nitou, both of Shizuoka (JP)

(73) Assignee: Unipres Corporation, Shizuoka (JP)

( * ) Notice: Subject to any disclaimer, the term of this patent is extended or adjusted under 35 U.S.C. 154(b) by 0 days.

(21) Appl. No.: 09/380,729

(22) PCT Filed: May 15, 1998

(86) PCT No.: PCT/JP98/02143

§ 371 Date: Sep. 8, 1999

§ 102(e) Date: Sep. 8, 1999

(87) PCT Pub. No.: WO99/06164

PCT Pub. Date: Feb. 11, 1999

(30) Foreign Application Priority Data

Jul. 31, 1997 (JP) ..... 9-206314

(51) Int. Cl.[7] ..... B21D 22/26

(52) U.S. Cl. ..... 72/354.8; 72/348; 72/358

(58) Field of Search ..... 72/349, 343, 352, 72/353.2, 354.6, 354.8, 355.4, 358, 359, 348, 391.2; 29/893.34

(56) References Cited

FOREIGN PATENT DOCUMENTS

| | | | |
|---|---|---|---|
| 61-296926 | * 12/1986 | (JP) | 72/349 |
| 1-205841 | 8/1989 | (JP) . | |
| 1-215429 | 8/1989 | (JP) . | |
| 6-246388 | 9/1994 | (JP) . | |
| 7-858283 | 9/1995 | (JP) . | |
| 7-284875 | 10/1995 | (JP) . | |

* cited by examiner

*Primary Examiner*—Lowell A. Larson
(74) *Attorney, Agent, or Firm*—Nixon Peabody LLP; Thomas W. Cole

(57) ABSTRACT

A method is provided for forming spline teeth on the walls of a press-formed sheet-metal article on which two peripheral walls of different diameters are disposed in a continuous manner via a step portion by means of a die with a plurality of steps of ironing surfaces, and a punch having a plurality of corresponding ironing surfaces. The punch is provided with a first punch and a second punch which are arranged in a split manner. The second punch first irons teeth on the larger diameter peripheral wall. While the first punch is next used to iron teeth on the smaller diameter peripheral wall, at least some of the pressurizing force on the second punch is maintained to avoid the creation of flaws in the step portion of the sheet metal article.

4 Claims, 8 Drawing Sheets

METHOD FOR IRONING SPLINE TEETH IN PRESSED STEPPED SHEETMETAL AND SHEETMETAL CLUTCH DRUM FORMED BY SAME

FIELD OF THE ART

The present invention concerns a method of forming spline teeth by ironing by engagement of a punch and die in the axial direction on the respective peripheral walls of a stepped, press-formed sheet-metal article, having peripheral walls of different diameter disposed in a continuous manner via a step portion, and particularly concerns a method of forming spline teeth by ironing on a press-formed sheet-metal article by which the spline teeth can be formed on a plurality of peripheral wall steps in a single forming operation. The formed article with spline teeth that is to be obtained by the method of the present invention is, for example, a clutch drum (formed article), in which, as shown in FIG. 1, spline teeth 2 and 3 are formed by ironing on each of the peripheral walls of a solid, press-formed sheet-metal drum 1 with which a bottomed small-diameter drum part 1*b* is disposed in continuation to a large-diameter drum part 1*c* via a step portion 1*a*.

BACKGROUND ART

Priorly, such a formed article 1 was obtained through two forming processes, that is, a process in which spline teeth are formed on large-diameter drum part 1*c* and a process in which spline teeth are formed on small-diameter drum part 1*b*.

However, since this procedure causes man-hours to increase and since deviations may occur in the concentricity of the upper and lower teeth 2 and 3, methods of simultaneously forming teeth 2 and 3 by a single forming process have been proposed.

FIG. 10 shows the structure of a die assembly for this type of simultaneous forming in which the inner periphery of die 4 is comprised of two steps in the vertical direction, that is, a small-diameter part 5 and a large-diameter part 6 disposed above small-diameter part 5 and wherein forming teeth 5*a* and 6*a* are formed on the inner periphery of each part.

On the other hand, punch 7 has a small-diameter punch part 8 and a continuing large-diameter punch part 9 formed integrally, and forming teeth 8*a* and 9*a* are formed on the outer periphery of the respective punch parts.

With the above arrangement, a to-be-processed article 10, which is a cup-shaped, press-formed sheet-metal article, having two step portions of a large and small diameter, respectively, prior to forming, is fitted onto punch 7 and then pressed into die 4 as shown in FIGS. 11(*a*) and (*b*) so that the forming teeth 5*a*, 8*a*, 6*a*, and 9*a* engage in the axial direction respectively. The peripheral walls of the to-be-processed article 10 is thereby ironed in the axial direction and a stepped, cup-shaped formed article 1, having spline teeth 2 and 3 of a protruded and indented form formed on the inner and outer peripheries, is thus obtained in one shot.

However, with the above-described simultaneous forming method, punch 7 is lowered at a constant pressurizing force to iron large-diameter drum part 1*c* and small-diameter drum part 1*b* of formed article 1 simultaneously. Thus in the forming process, the ironed material on the peripheral wall of small-diameter drum part 1*b* is pushed outwards (made to flow outwards) at step portion 1*a* of formed article 1 as shown by the arrow in FIG. 11(*a*) and bulges in the form of excess thickness A at the upper side of step 1*a*. Furthermore, as shown in on enlarged manner in FIG. 11(*b*), the excess thickness A is pressed by the step 7*a* of punch 7, causing a defect B, which may be a gouge, shrinkage cavity, or entrainment, to occur and cause a portion of the article to become thin and weak in strength.

The bulge due to the excess thickness that forms at step 1*a* is especially significant when step 1*a* is to be formed to be perpendicular to the peripheral walls, and such a bulge must be cut off if the formed article is to be used in a clutch drum. Thus if the formed article is to be used as it is in a clutch drum and without performing a cutting process, the step 1*a* between small-diameter drum part 1*b* and large-diameter drum part 1*c* must be inclined as shown in FIG. 11(*b*) so that the bulge due to excess thickness A will not protrude towards the inner side of large-diameter drum part 1*c*. It was therefore difficult to form step 1*a* to be perpendicular to the peripheral walls.

Thus with the prior art, it was difficult to make the diameter difference D between the upper and lower parts at step 1*a* large since this lead to the increasing of the axial length of step 1*a*, and thus to the increasing of the axial length of the clutch drum, which in turn lead to the increasing of the size of the entire clutch device.

Upon examining the causes by which excess thickness A and defect B occur, the present inventor found that since a gap C is formed between formed article 1 and punch step 7*a* in consideration of the elongation of small-diameter drum part 1*b*, the material that flows upward in the axial direction by the iron-forming of small-diameter drum part 1*b* bulges at step 1*a* and is then pressed by punch step 7*a* to give rise to excess thickness A and defect B.

Thus in order to prevent a gap from being formed between the step portions of the processed article and the punch, the present inventor provided the punch with an arrangement in which it was split into a first punch for forming small-diameter part 1*b* and an outer peripheral punch for forming large-diameter drum part 1*c*, and by maintaining the ironing pressure of the first punch after forming large-diameter drum part 1*c* and controlling the ironing pressure of the outer peripheral punch to be lower than the normal ironing pressure in ironing the small-diameter drum part 1*b* so that the ironing pressure of the outer peripheral punch will not act on the step of the processed article or the small-diameter drum part, was able to obtain a processed item with which neither excess thickness A nor defect B occurred at the step portion.

The present invention was made based on the above-described problems of the prior art and on the findings of the inventor, and the objects thereof include the provision of a method for forming spline teeth by ironing on a stepped, press-formed sheet-metal article and a provision for a sheet metal clutch drum formed by ironing by said method, with which excess thickness does not occur at the step portions in the process of iron-forming the spline teeth on a plurality of step portions in one shot and with which forming can be performed without geometrical restrictions such as in the differences in diameter between upper and lower parts, inclination of the step portion, etc.

DISCLOSURE OF THE INVENTION

To achieve the above object, the invention provides a method for forming spline teeth by ironing on a stepped, press-formed sheet-metal article, wherein a forming die, having a plurality of steps of ironing surfaces corresponding to the outer peripheral shape of a to-be-processed article, which is a press-formed article, and a forming punch, having a plurality of steps of ironing surfaces corresponding to the inner peripheral shape of the to-be-processed article, are engaged in the axial direction to form spline teeth by ironing on at least one of either the inner or outer surfaces of the respective peripheral walls of a solid, stepped, cup-shaped, press-formed sheet-metal article with which a plurality of peripheral walls of different diameters are disposed in a continuous manner via step portions, said method being characterized in that the abovementioned punch has an arrangement in which it is split into a first punch, which coacts with the corresponding ironing surface at the die side to form spline teeth by ironing on the peripheral wall of the deepest part of the to-be-processed article, and one or a plurality of outer peripheral punches, each of which is disposed coaxially at the outer periphery of the first punch, coacts with the corresponding ironing surface at the die side to form spline teeth by ironing on the peripheral wall of the corresponding step portion of the to-be-processed article, and is lowered to and stopped at the step position of the corresponding step portion of the die, and while the abovementioned first punch and outer peripheral punches are lowered integrally to perform ironing in order, starting from the outer peripheral wall of the article to be processed, after the ironing of an outer peripheral wall, the ironing pressure on the outer peripheral wall in the process of ironing a peripheral wall at the inner side thereof is controlled so as to lower the inflow of material into the step portion due to ironing of the inner peripheral wall.

When the peripheral wall disposed in continuation to the inner side of the step part of the processed article is ironed by the punch, though a part of the peripheral wall material will tend to flow towards the step portion side, since the ironing pressure on the outer peripheral wall is controlled, the flow of material towards the step portion side due to the ironing of the inner peripheral wall will be restricted and excess thickness will not occur at the step portion.

The invention also provides a method for forming spline teeth by ironing on a stepped, press-formed sheet-metal article as set forth in the first claim, wherein for the abovementioned control of the ironing pressure on the outer peripheral wall, after the ironing of the outer peripheral wall and prior to the starting of the ironing of the inner peripheral wall, a pressure that is lower than the ironing pressure is made to act on the outer peripheral punch that irons the outer peripheral wall, and the inner peripheral wall is ironed by the inner punch that descends with respect to the outer punch, and is thereby elongated smoothly in the axial direction so that the flow of material towards the step portion side will be restricted.

The invention additionally provides a method for forming spline teeth by ironing on a stepped, press-formed sheet-metal article wherein teeth for forming spline teeth are formed respectively on the abovementioned plurality of steps of ironing surfaces of the punch and the plurality of steps of ironing surfaces of the die to enable the forming of spline teeth on both the inner and outer peripheries of the peripheral walls.

The invention finally provides a sheet-metal clutch drum wherein spline teeth are formed by ironing the inner peripheral surface of a large-diameter drum and the outer peripheral surface of a small-diameter drum of a solid, press-formed sheet-metal drum in which a large diameter drum part is provided in continuation to a bottomed, small-diameter drum with via a perpendicular step, and with this clutch drum, while the peripheral wall of the small-diameter drum part is being ironed, the small-diameter drum part elongates downwards so that the flow of material to the perpendicular step portion side of the small-diameter drum part will be restricted, thereby preventing the formation of an excess thickness portion at the perpendicular step portion, and furthermore, since the perpendicular step portion is pressed and retained against the step portion of the die at a suitable pressure by the outer peripheral punch, the perpendicular step portion is formed to have a flat shape.

PREFERRED EMBODIMENTS OF THE INVENTION

Figure 1:
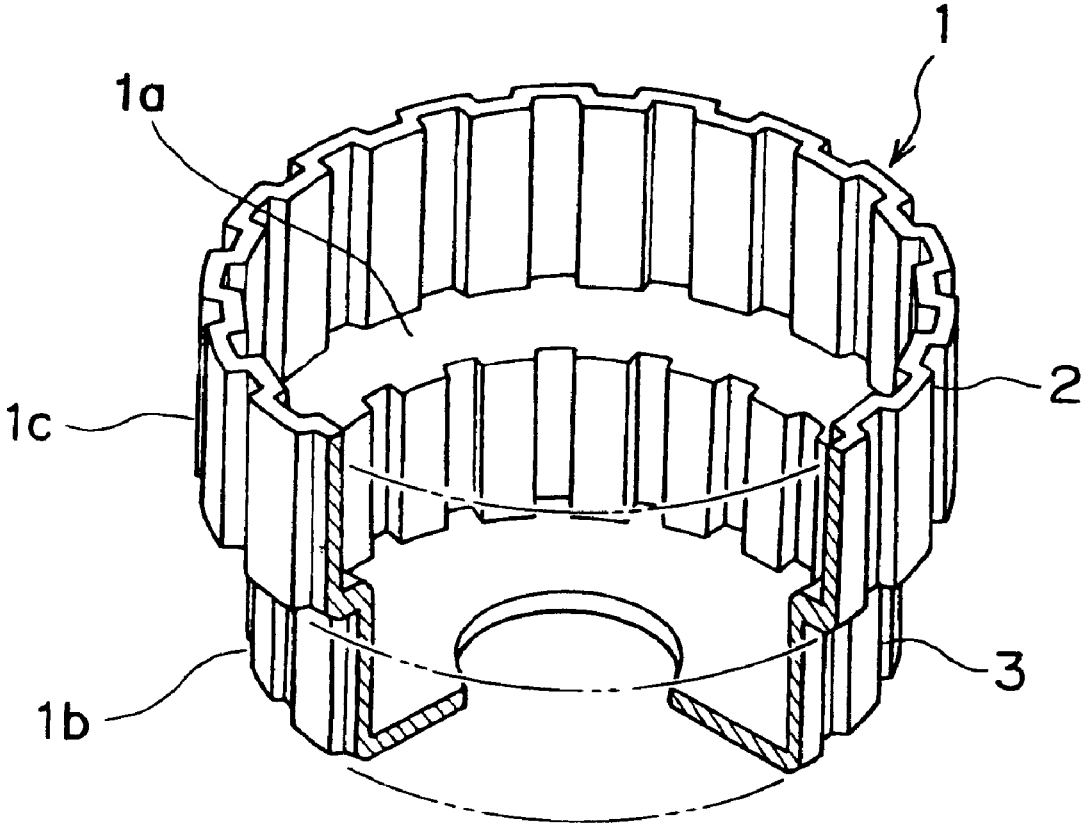
FIG. 1 is a perspective view of a sheet-metal clutch drum on which spline teeth are formed by the method of the present invention.

Preferred embodiments of the present invention shall now be described in detail with reference to the attached drawings. FIG. 1 is a perspective view of a clutch drum that has been formed by the method of the present invention, FIG. 2 is a sectional view of the overall arrangement of a die assembly to which the method of the first embodiment of the present invention is applied, FIG. 3 through FIG. 6 are diagrams that illustrate the forming procedure using the same die assembly, and FIG. 7 is a diagram that shows the pressurizing forces that act on the punches of the same die assembly.

Figure 2:
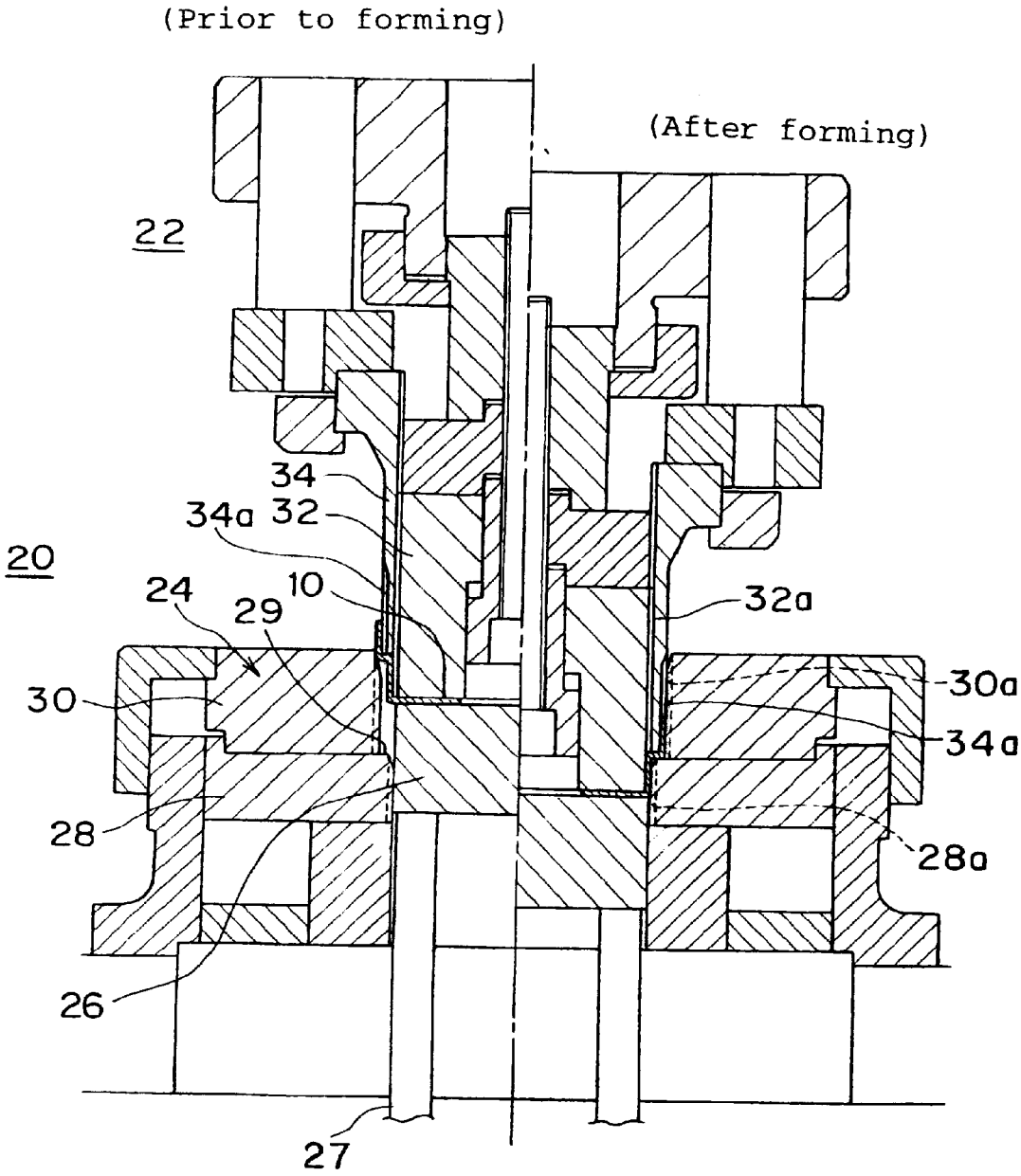
FIG. 2 is a sectional view, which shows the overall arrangement of the die assembly for carrying out the method of the invention.

The die assembly shown in FIG. 2 is an assembly for forming spline teeth 2 and 3 by ironing on each of the peripheral walls of a to-be-processed article 10, which is a solid, press-formed sheet-metal drum with which a large-diameter drum part 1*c* is formed in continuation to a bottomed, small-diameter drum part 1*b* via a perpendicular step portion 1*a*, and this assembly is comprised of a lower mold 20 and an upper mold 22, disposed so that it can be elevated and lowered with respect to lower mold 20.

Lower mold 20 has an arrangement having a die 24, with an inner surface shape corresponding to the outer peripheral shape of to-be-processed article 10, a cushion 26, which is disposed from the lower part to the inner part of die 24 and supports the bottom part of to-be-processed article 10, a knockout pin 27, which knocks out to-be-processed article 10 after forming, and various equipment associated with the above being provided on a base.

Die 24 is comprised of a small-diameter die part 28 at the lower part and a large-diameter die part 30, which is made continuous with small-diameter die part 28 via a perpendicular step 29 and is opened above lower mold 20, and teeth 28*a* and 30*a* for forming spline teeth are formed on the inner peripheral surfaces (ironing surfaces) of each die part.

Meanwhile, upper mold 22 is comprised of a first punch 32, which can be elevated and lowered in the axial direction and is for ironing the small-diameter drum part 1*b*, a second punch 34, which is disposed coaxially and at the outer periphery of first punch 32 and which can be elevated and lowered in the axial direction independent of first punch 32, and an elevating and lowering mechanism associated with these punches. Teeth 32*a* and 34*a* for forming spline teeth are also formed on the outer peripheries (ironing surfaces) of first punch 32 and second punch 34.

Dies 28 and 30 and punches 32 and 34 are arranged and disposed so that the corresponding teeth 28*a* and 30*a* and teeth 32*a* and 34*a* engage with each other in the axial direction so as to form spline teeth 2 and 3 by ironing on the inner and outer peripheral surfaces of the upper and lower peripheral walls, respectively, of to-be-processed article 10 with the gap between die 24 and punches 32 and 34 being the material thickness as shown in FIG. 1.

In particular, after punches 32 and 34 have been lowered integrally and have formed spline teeth 2 by ironing on large-diameter drum part 1*c* and before the ironing of small-diameter drum part 1*b* by first punch 32 is started, the pressurizing force that acts on second punch 34 is controlled to be smaller than the ironing pressure so that the material of excess thickness that tends to flow into step portion 1*a* when small-diameter drum part 1*b* is ironed by first punch 32 will be restricted (absorbed) by the smooth elongation of small-diameter drum part 1*b* in the axial direction by the ironing process and excess thickness will not arise at the perpendicular step portion 1*a*.

The introduction part $28a_1$ of teeth 28*a* is formed to be inclined at an angle of 30 to 45 degrees with respect to the vertical direction so that the effective teeth length at small-diameter drum part 1*b* can be made large.

The manner by which spline teeth are formed on each of the peripheral walls of the to-be-processed article by the above-described die assembly shall now be described in detail with reference to FIG. 3 through FIG. 7.

Figure 3:
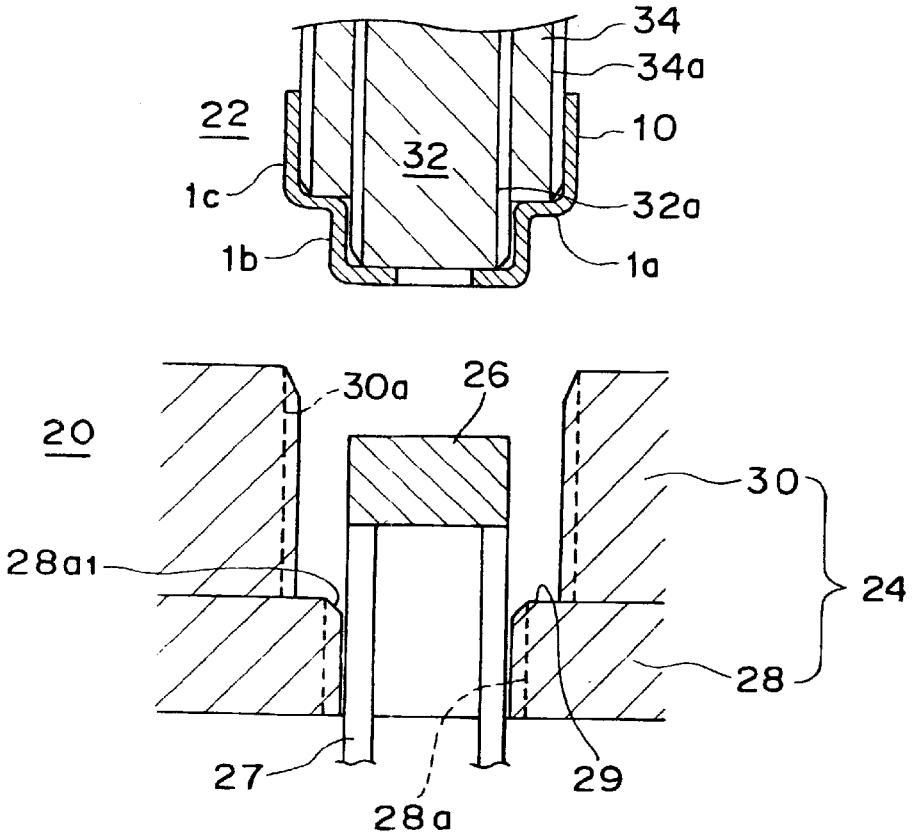
FIG. 3 is an explanatory diagram of the process of forming spline teeth on a clutch drum using the same die assembly and shows the condition where the to-be-processed article has been mounted onto the punch.

As shown in FIG. 3, with first and second punches 32 and 34 being set at the standby position at which they are separated from the die surface of lower mold 20, the to-be-processed article 10, which is a press-formed article having the form of a stepped, bottomed container, is set by fitting onto punches 32 and 34.

Figure 4:
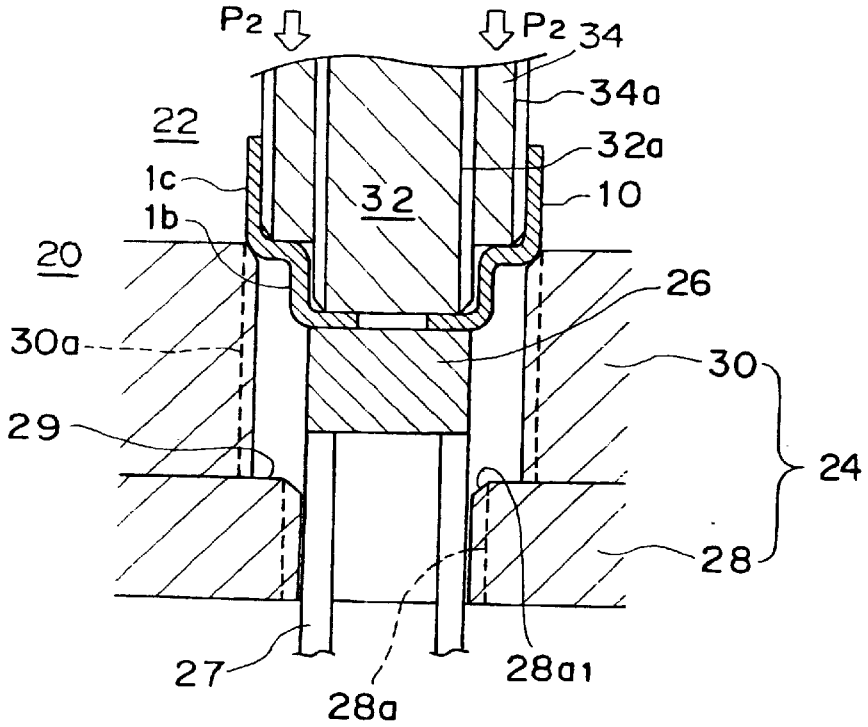
FIG. 4 is an explanatory diagram of the process of forming spline teeth on the clutch drum using the same die assembly and shows the condition immediately prior to the start of ironing of the large-diameter drum part.
Figure 5:
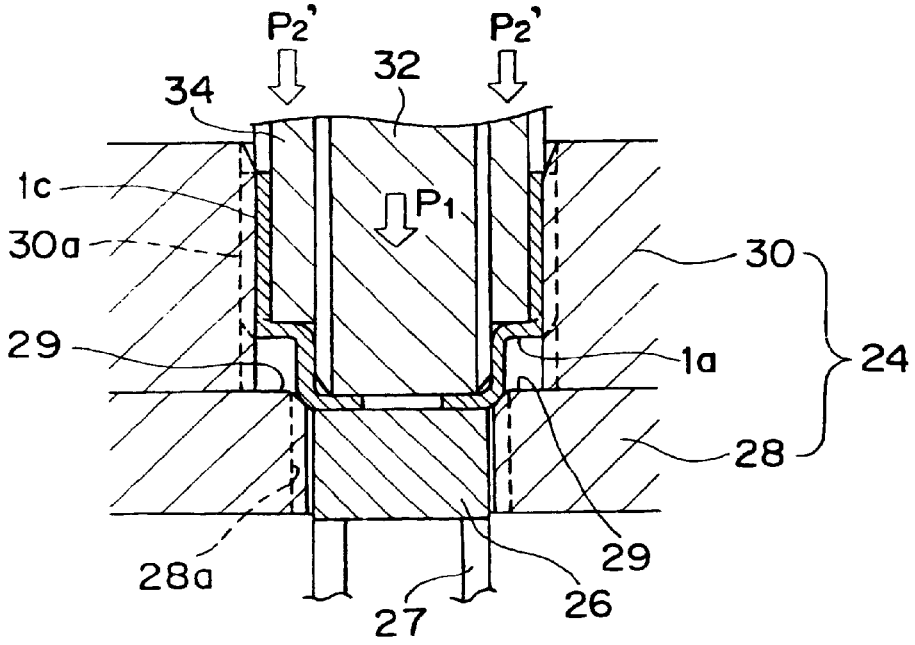
FIG. 5 is an explanatory diagram of the process of forming spline teeth on the clutch drum using the same die assembly and shows the condition after the ironing of the large-diameter drum part and immediately prior to the ironing of the small-diameter drum part.

Then with processed article 10 being supported from below by cushion 26, first and second punches 32 and 34 are lowered integrally as shown in FIGS. 4 and 5. A predetermined pressurizing force $P_2$ for ironing acts on second punch 34, and as shown in FIG. 5, the large-diameter drum part 1*c* of processed article 10 is ironed by second punch 34 and large-diameter die part 30. The large-diameter drum part 1*c* in this ironed condition is elongated in the axial direction in comparison to the large-diameter drum part 1*c* prior to ironing. A predetermined pressurizing force $P'_1$ ($<P_2$) acts on first punch 32, which is thereby locked in position with respect to second punch 34 and is lowered integrally with second punch 34.

Then, as shown in FIG. 5, after the ironing of large-diameter drum part 1*c* by second punch 34 and large-diameter die part 30 is ended, the pressurizing force that acts on second punch 34 is decreased from $P_2$ to $P'_2$ in accordance with the start of ironing of small-diameter drum part 1*b* by first punch 32 and small-diameter die part 28 and the pressurizing force that acts on first punch 32 is switched from the initial pressurizing force $P'_1$ to the predetermined pressurizing force $P_1$ ($>P'_1$) for ironing. Then with the lowering of punches 32 and 34, independently of each other as shown in FIG. 6, small-diameter drum part 1*b* is ironed by first punch 32 and small-diameter die part 28.

In this process of ironing small-diameter drum part 1*b*, the material at small-diameter drum part 1*b* tends to flow vertically in the axial direction due to the ironing. However, since as illustrated in FIG. 7, which shows the characteristics of the pressurizing forces that act on punches 32 and 34 of the die assembly, the pressurizing force $P_1$ of the first punch is greater than the small pressurizing force $P'_2$ of second punch 34, which presses against step portion 1*a*, small-diameter drum part 1*b* is ironed and thereby elongated smoothly in the axial direction by the first punch 32, which descends with respect to second punch 34, and the amount of material that flows from small-diameter drum part 1*b* into perpendicular step portion 1*a* is thereby restricted.

Figure 6:
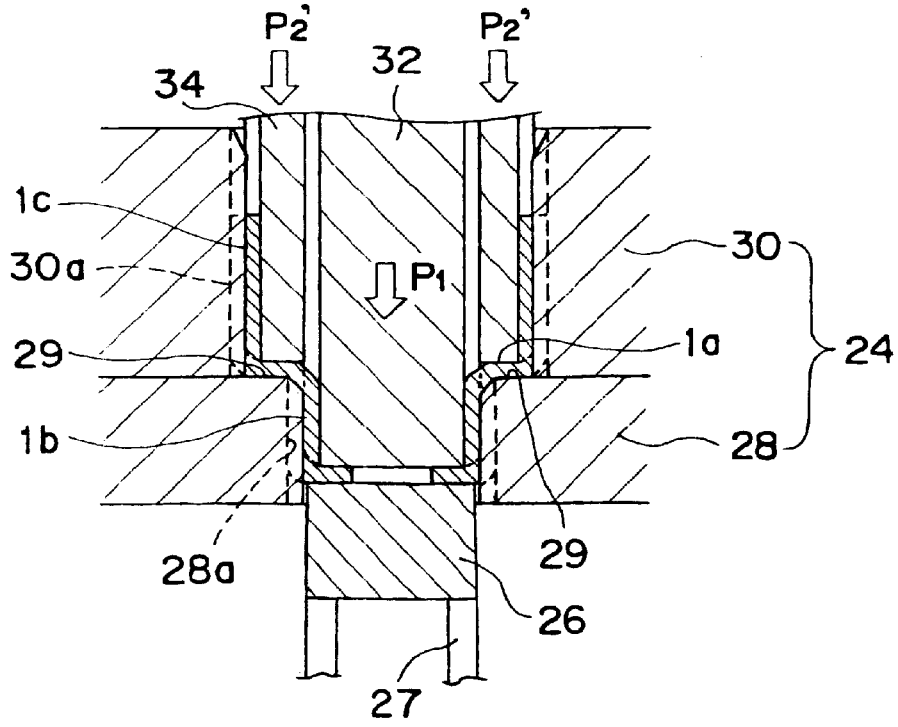
FIG. 6 is an explanatory diagram of the process of forming spline teeth on the clutch drum using the same die assembly and shows the condition after the end of ironing of the small-diameter drum part.
Figure 7:
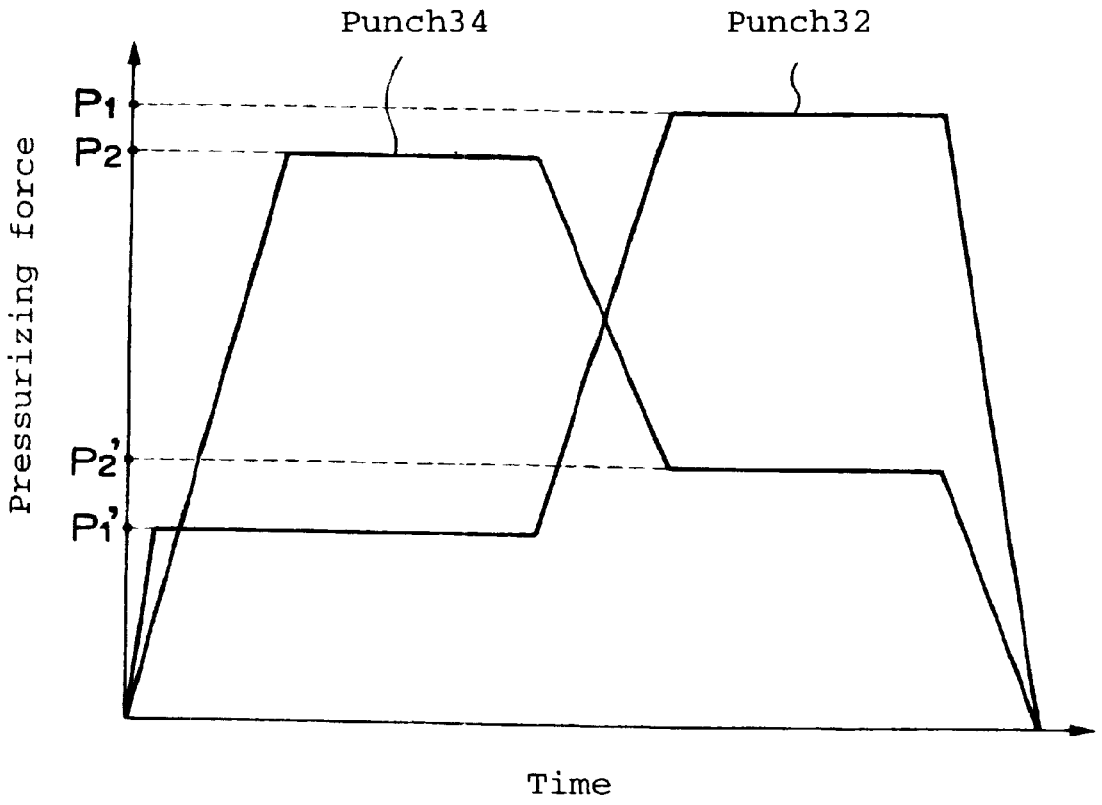
FIG. 7 is a diagram that shows the characteristics of the pressurizing forces which act on the first punch and the second punch.

Furthermore, as shown in FIG. 6, since the lowered second punch 34 presses and retains step portion 1*a* of processed article 10 against step 29 of the die at the pressurizing force $P_2$, step portion 1*a* is formed to have a flat shape.

Thereafter, first punch 32 and second punch 34 are raised integrally in a reverse order than that described above and knockout pin 27 is protruded to eject formed article 1.

The clutch drum 1, which is the formed article made by the above processes, has spline teeth 2 formed on the inner and outer peripheral surfaces of its large-diameter drum part 1*c* and has spline teeth 3 formed on the inner and outer peripheral surfaces of its small-diameter drum part 1*b*. Furthermore, as shown in FIG. 1, step portion la is perpendicular to the peripheral walls and is still flat, and an adequate difference in diameter is provided between large-diameter drum part 1*c* and small-diameter drum part 1*b*.

Figure 8:
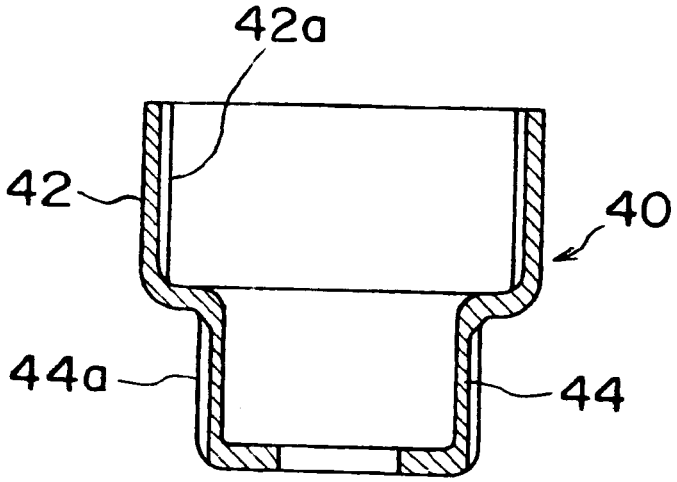
FIG. 8 is a sectional view of another formed article to which another embodiment of the method of the invention has been applied.

Although teeth for forming spline teeth were formed on each of the ironing surfaces (outer peripheral surfaces) of the plurality of punches that were arranged in a split manner and the ironing surfaces (inner peripheral surfaces) of the plurality of dies corresponding to the respective punches with the above-described embodiment, the die structure may also be one with which teeth for forming spline teeth are formed on one of either of the corresponding ironing surfaces of the punches and dies. FIG. 8 is a sectional view that shows a press-formed sheet-metal article formed by ironing by the method of the second embodiment of the present invention, and the structure of the article is one in which spline grooves 42*a* and 44*a* are formed only on the inner peripheral surface side of large-diameter drum part 42 and the outer peripheral surface side of small-diameter drum part 44.

In this case, the die structure may be one in which teeth are not formed on the ironing surface (inner peripheral surface) of the large-diameter die part 30 of the die assembly of the above-described first embodiment for forming the outer peripheral surface of large-diameter drum part 42 and on the ironing surface (outer peripheral surface) of first punch 32 of the first embodiment for forming the inner peripheral surface of small-diameter drum part 44.

Figure 9:
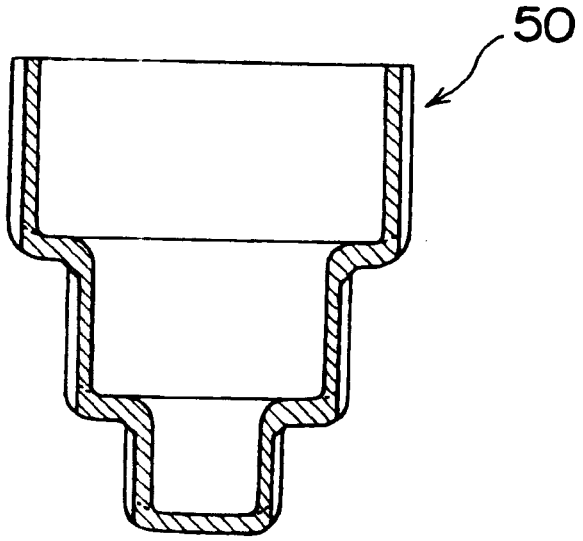
FIG. 9 is a sectional view of a formed article to which yet another embodiment of the method of the invention has been applied.
Figure 10:
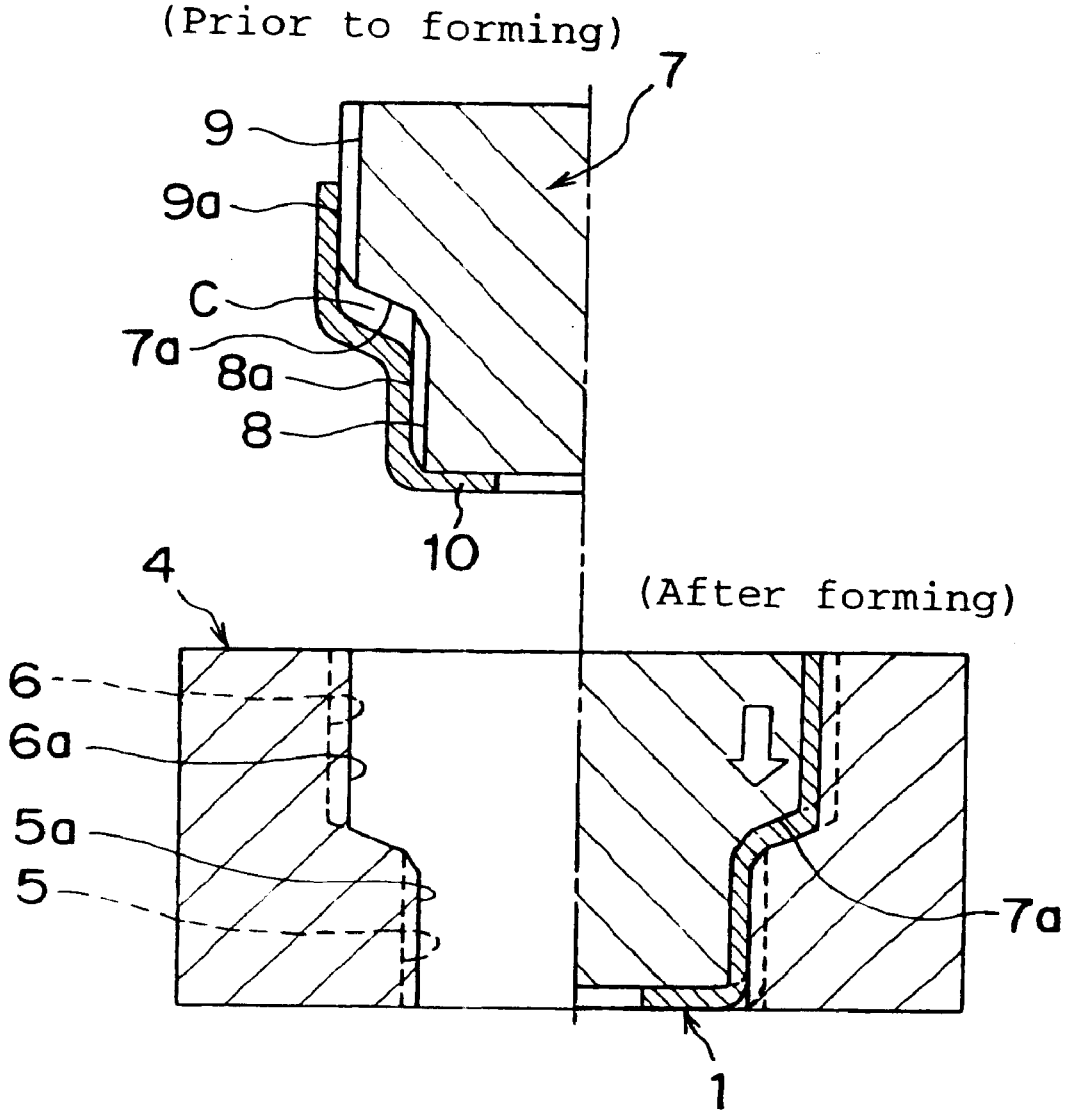
FIG. 10 is sectional view of principal parts of the conditions before and after forming by the prior-art process for simultaneous forming of spline teeth.
Figure 11:
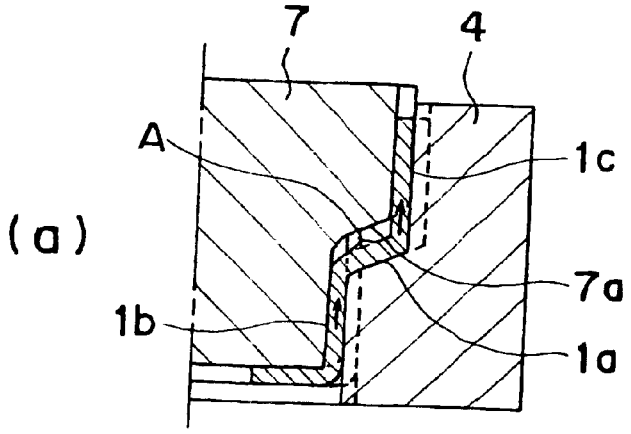
FIGS. 11*a* and 11*b* are cross sectional side views of a prior art punch and die forming spline teeth on a clutch drum, with an enlarged view in FIG. 11(*b*) of a step portion in the drum and the flaw that usually occurs therein.
Figure 11:
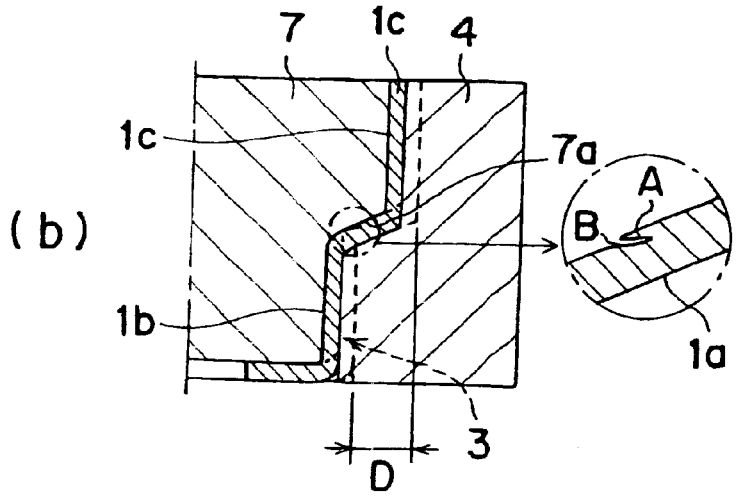

FIG. 9 shows a stepped, container-like, press-formed article with which spline teeth are formed on the inner and outer peripheral surfaces of the peripheral walls of three steps by the method of the third embodiment of the present invention. In this case, the structure is one in which a third punch, that can be elevated and lowered relatively, is coaxially disposed at the outer periphery of the second punch 34 in the die assembly of the above-described first embodiment and a die corresponding to the third punch is coaxially disposed above large-diameter die part 30. With this embodiment, after the ironing of the outermost peripheral wall by the third punch, the pressurizing force of the third punch is controlled to iron the peripheral wall at the inner side thereof, and after the end of ironing of this inner peripheral wall, the pressurizing force of second punch 34 is controlled to iron the innermost peripheral wall so that the inflow of material into the step portions of the processed article will be lessened and an excess thickness part will not form on the two perpendicular step portions.

Though spline teeth were formed on the inner peripheries and/or the outer peripheries of the peripheral walls of the press-formed article in the above embodiments, gear teeth, for example, and other types of teeth in general may also be formed.

Industrial Applications

As is clear from the above explanation, by the method for forming spline teeth by ironing of the present invention, since there is little inflow of material into the step portions of an article to be processed in the process of forming spline teeth by ironing, the occurrence of excess thickness at the step portions and accompanying defects can be prevented. Restrictions on the diameter difference between a small-diameter part and a large-diameter part can thus be alleviated and since flatness can be secured at the step portions, product design with a higher degree of freedom can be carried out. Also, with the clutch drum of the present invention, the diameter difference between an outer-diameter drum part and a small-diameter drum part may be made large without having to make the drum large in the axial direction and thus without having to make the clutch device large.

What is claimed is:

1. A method for forming two sets of spline teeth on a sheet metal article by ironing said sheet-metal article between a forming die, and a forming punch, wherein said sheet metal article has a smaller and a larger diameter portion connected by a stepped portion and said two sets of spline teeth are formed on said smaller and larger diameter portions, respectively, and said punch includes a first punch for coacting with the smaller diameter portion of said sheet metal article, and at least one second punch which is disposed coaxially with respect to the first punch and is separately movable with respect to said first punch for coacting with the larger diameter portion of the sheet-metal article, comprising the sequential steps of:

(a) moving the second punch into pressurized engagement with said larger diameter portion of said article to iron a set of spline teeth on said larger portion, and (b) moving the first punch into pressurized engagement with said smaller diameter portion of said article to iron a set of spline teeth on said smaller portion, wherein said second punch remains in pressurized engagement with said larger diameter portion during step (b) so as to lower an inflow of sheet metal material into the step portion.

2. A method for forming spline teeth on a stepped sheet-metal article as set forth in claim 1, wherein the pressure applied to the larger diameter portion of said article by the second punch during step (b) is lower than the pressure applied to said larger diameter portion during step (a).

3. A method for forming spline teeth on a stepped, sheet-metal article as set forth in claim 2 wherein the pressure applied to the larger diameter portion of said article by the second punch during step (b) is less than half of the pressure applied to said larger diameter during step (a).

4. A sheet-metal clutch drum having larger and smaller diameter portions separated by a step portion wherein spline teeth are formed on said layer and smaller diameter portions by a method as set forth in claim 1.

* * * * *